US008714820B2

(12) United States Patent
Mino et al.

(10) Patent No.: US 8,714,820 B2
(45) Date of Patent: May 6, 2014

(54) SINGLE BAR FLEXIBLE BULK CARGO LINER

(75) Inventors: Oswaldo Mino, Houston, TX (US); Pablo Llopez-Miquel, Spring, TX (US)

(73) Assignee: D & BD Marketing LLC, The Woodlands, TX (US)

( * ) Notice: Subject to any disclaimer, the term of this patent is extended or adjusted under 35 U.S.C. 154(b) by 239 days.

(21) Appl. No.: 13/317,879

(22) Filed: Oct. 31, 2011

(65) Prior Publication Data

US 2012/0048847 A1 Mar. 1, 2012

Related U.S. Application Data

(63) Continuation-in-part of application No. 11/961,855, filed on Dec. 20, 2007, now Pat. No. 8,083,412.

(51) Int. Cl.
*B65D 33/00* (2006.01)
*B65D 33/02* (2006.01)
*B65D 88/00* (2006.01)

(52) U.S. Cl.
USPC ..... 383/105; 383/119; 383/903; 220/1.6

(58) Field of Classification Search
USPC ..... 383/105, 119, 903, 22; 220/1.6, 495.01, 220/495.05, 495.06, 652, 601
See application file for complete search history.

(56) References Cited

U.S. PATENT DOCUMENTS 3,809,279 A 5/1974 Arjas
3,949,901 A 4/1976 Tokita
3,980,196 A * 9/1976 Paulyson et al. ..... 220/1.5
4,237,653 A 12/1980 Cortez
4,541,765 A 9/1985 Moore
5,137,170 A 8/1992 Matias
5,188,460 A 2/1993 Dorse
5,203,622 A 4/1993 Derby
5,222,621 A 6/1993 Matias
5,289,937 A 3/1994 Boots
5,316,387 A 5/1994 Polett et al.
5,328,268 A 7/1994 LaFleur
5,421,476 A 6/1995 Matias
5,538,155 A 7/1996 Hoekstra
5,542,563 A 8/1996 Matias
5,641,179 A 6/1997 Imlach
5,649,767 A 7/1997 Nickell et al.
5,657,896 A 8/1997 Matias
6,250,488 B1 * 6/2001 Narahara et al. ..... 220/1.6
6,293,459 B1 9/2001 Burch, Jr.
6,481,598 B1 11/2002 Thornsen
6,565,256 B2 5/2003 Derby et al.
6,579,009 B1 6/2003 Schinasi
7,320,408 B2 1/2008 McMahon et al.

(Continued)

*Primary Examiner* — Jes F Pascua
(74) *Attorney, Agent, or Firm* — Michael L. Parks; Parks & Associates, P.C.

(57) ABSTRACT

Flexible apparatus for transporting bulk products within containers having liners with bottom panels, two sidewalls, and a back panel with one lateral receiving member across the back panel and having first, second, and third sheet members partially attached to the two sidewalls and the back panel for creating a first, second, and third pair of diagonal sections suspended between the two sidewalls and the back panel and for creating planar overlapping spaced apart sections of first, second, and third sheet member across the back panel for bulge control in back panel and having one support bar with securing members for positioning and securing the first, second, and third sheet members and their diagonal sections and back panel into vertical and tensioned positions to container.

31 Claims, 7 Drawing Sheets

(56) References Cited

U.S. PATENT DOCUMENTS

| | | | | |
|---|---|---|---|---|
| 7,506,776 | B2 | 3/2009 | Podd | |
| 7,516,863 | B2 | 4/2009 | Siegers et al. | |
| 7,967,161 | B2 * | 6/2011 | Townsend | 220/1.6 |
| 8,083,412 | B2 * | 12/2011 | Mino et al. | 383/105 |
| 2003/0197009 | A1 | 10/2003 | Mino | |
| 2005/0173159 | A1 | 8/2005 | Murata et al. | |
| 2007/0024078 | A1 | 2/2007 | Mino et al. | |
| 2007/0235509 | A1 | 10/2007 | Townsend | |
| 2007/0267410 | A1 | 11/2007 | Mino et al. | |

* cited by examiner

SINGLE BAR FLEXIBLE BULK CARGO LINER

RELATED APPLICATION

This application is a continuation-in-part of U.S. patent application Ser. No. 11/961,855 filed Dec. 20, 2007 now U.S. Pat. No. 8,083,412.

BACKGROUND OF THE INVENTION

1. Field of the Invention

This invention relates to flexible liners for use in shipment and storage of bulk materials in shipping containers which are used in vessels, trucks, trains, and other means of moving containers. The containers herein referred to are generally rectangular containers of the standard size which can be easily loaded and stacked on the various means for moving them in commerce and for storage. These containers have flexible liners installed in them which substantially conform to the shape of the generally rectangular or square container to receive the bulk cargo. In some cases the liners used in shipping containers are also known as "bulkhead" or "safety sheets" which generally do not line the whole container but line parts of a container such as two sidewalls, a floor and an end face/back panel which corresponds to the shipping container door and are placed in a container at its door end prior to filling. Bulk cargo includes such items or substances as forms of powder, pellets, flakes, granules and may include certain forms of liquid. Common examples of bulk cargo are coffee beans, plastic pellets, grains, and the like.

2. Description of Related Art

The use of flexible liners for installation in a standard international container for use in cargo vessels, trucks, railcars, and storage spaces are well known and they are designed to be inserted within the generally rectangular container and substantially conform to the shape of the rectangular container whether completely lining the container or conforming to only a portion of the container such as with "bulkhead" or "safety sheets". These liners substantially cover the inside of the cargo vessel container for receiving the bulk materials and therefore the stored bulk materials inside the liner do not come in contact with the container walls or floor in one case and in the other cases only contact the container walls uncovered by the liners referred to as "bulkhead" or "safety sheets".

The container liners of the prior art have come in two general types, whether full liners or "bulkhead" or "safety sheets". The two types being those using metal support bars which are positioned across the end face or back panel which corresponds with the container doors and placed in the channel edges of the container door to secure the liner and those using various strap configuration which are attached to the container to hold the liner in the container for loading and unloading bulk cargo.

The problem with strap configurations in the prior art is that the 4 corner eye-latches in the corners of containers are not always located based on industry standards as to position of the eye-latches in the container and therefore relying on these anchoring points to tension straps and secure bars to make these system work was unpredictable relative to the performance of the prior art type flexible apparatus. Additionally, attempting to restrain the bulkhead bulging with a multitude of straps, often in the form of a net, incurs in substantial installation time of the liner inside of the container.

Also the prior art did not recognize and allocate material and reinforcement to the positions of the back panel where the greatest hydrostatic pressures occurred in the middle and lower sections of the back panel. The prior art simply tried to reinforce the back panel by providing holding straps and other rigid means for retaining the back strap against bulging.

The flexible container liners of the prior art may, even after being secured within the container, have its end panel, which corresponds to the doors of the shipping container, bulge out outwardly into the doorway opening of the container, when filling of a container with bulk product occurs. The bulging of the end panel of the liner is caused, because of the hydrostatic head created by the bulk product against the back panel. The bulging outwardly of the back panel into the doorway may obstruct the closing of the door of the container. Also bulk product cargos have a tendency to move about during shipment and can put greater hydrostatic head pressure on the back panel causing it to instantaneously bulge outwardly at the opening of the back doors of the container upon opening the container at its destination. This outward instantaneous bulging at the opening of the back doors of the container can be dangerous to stevedores or dockhands by driving the doors into them. Also, this instantaneous outward bulging can be a problem for containers which must be opened for inspection before reaching their final destination because the bulging out can prevent the doors of the container from being reclosed after cargo inspection or custom clearance.

In many cases the prior art using barless liners had to have additional safety bars, for a safety feature, to be used across the back panel for tilting discharge of the cargo, but many times the flexible containers had bulged so far outward that the metal bars could not be inserted across the back panels and locked in the channels on the inside of the doors to the container which prevented the use of the safety bars on tilting discharges.

The ability to control the hydrostatic head of the bulk product which causes bulging outward of the back panel is further compounded by the need for loading and discharge ports being located in the back panel to facilitate the loading and unloading of bulk materials into the liner positioned in the container. The loading and discharge ports must be clear and open to receive and discharge the bulk product without interfering with the bulk product flow in and out of the liner. Further, the loading and discharge ports must be clear of metal support bars or the various strap configurations which are used to attach the liner to the container to allow free outflow of bulk product. Also, some unloading procedures, such as tilting discharge, of containers further increase hydrostatic head against the back panel when the whole container and liner are tilted upward from the end opposite the container doors and the back panel to discharge the bulk product.

Various configurations of metal bar support members being placed across the back panel and various strap systems across the back panel and down the respective sides of the container liner have been used to attempt to control the hydrostatic head of the bulk product against bulging the back panel outward into the doorway of the container when the doors are open have proved from a safety perspective to be ineffective or expensive to install.

Also various strap systems have been used which are anchored to the back panel at one end and anchored at the other end to the floor panel or sidewall panels of the container liner, which is secured to the container, to attempt to secure the back panel against the effects of the hydrostatic head of the bulk product from bulging out the back panel into the doorway. The strap systems have been designed for maximum force pull back and to hold the back panel from bulging forward into the doorway by using strap angles of 60° or greater with the back panel to achieve as much holding force or pulling back force vectors as possible between the strap anchored to the back panel and the other strap end secured to the floor or either end of the liner. The prior art used strap holding force not hydrostatic forces applied to the straps to help hold the bulging forces in check. Also the restraining force of a strap is limited to the surface area of the strap itself (typically no more than 2" in width), and therefore significant bulging still occurs in between straps.

Yet another problem as those skilled in the art will recognize is that the bulk product must be free to flow both into and out of the liner which is mounted in the container during loading and discharging of the bulk product. However if product is free to flow into and out of the liner, then it is free to flow during shipment which can cause a very large buildup of bulk product at the back panel with a corresponding high hydrostatic head against the back panel upon container's arrival at its destination. This negative tendency of shifting and stacking of bulk products causes increased hydrostatic head on the back panel which can be further enhanced when a tilting discharge of the container is required. A tilting discharge means that the container with this liner inside is tilted upward on its end away from its back panel to allow gravity to cause the bulk product to flow toward the back panel for discharge of the bulk product, but increases the hydrostatic head on the back panel which can cause it to fail causing uncontrolled release of the bulk product.

Baffles have been used within the liners to control the bulk product flow within the liners during shipment but these have tended to also be at steep angles such as toward 90° with the back panel so as not to interfere with the bulk product loading or discharge. The use of steep angles toward 90° were also used to give the baffles greater holding back effects on the back panels but effectively created separate compartments which are run lengthwise of the liner in the container. Because the baffles created separate compartments which are run lengthwise of the liner in the container, the bulk product in the separate compartments did not control the hydrostatic head of the bulk product against the back panel for control of the back panel's outward bulging through the doorway of the container. Not only were these lengthwise panels too intrusive in the loading space of the container, but also they did not stay in their position once the bulk product was loaded, as the bulk product inside of the container tried to distribute itself within this loading space, and encountered these barriers, that ultimately were forced out of position due to their flexible fabric material.

SUMMARY OF THE INVENTION

The object of this invention in summary is to create a flexible liner with a non-bulging back panel or non-bulging back panel insert for a container which has synergistic effects for bulge control of the back panel to prevent it protruding into the doorway of the container and for controlling the flow of bulk product within the container both during shipment, loading and unloading. The synergistic effects of the novel combination of elements and the use of the hydrostatic head created by the bulk products which are loaded into flexible liner in the container are used for creating restraining vector forces within the components of the flexible liner to assist in bulge control in the back panel.

In its simplest form, the flexible liner of this invention uses at least a bottom panel which sits on the floor the container, two sidewalls which run parallel with the sidewalls of the container, a back panel which is faced to the doors of the container having at least one receiving member laterally across the back panel and a support bar disposed in the one lateral receiving member of the back panel; first and second sheet members partially attached to the two sidewalls and to the back panel for creating a first and second pairs of diagonal section sheet members which are suspended between the two sidewalls and the back panel and for creating a planar overlapping section of the first and second sheet member with the back panel and a pair of securing members for raising the support bar to position the first and second sheet members and their first and second pair of diagonal shaped section members into vertical and tensioned positions and the back panel into vertical and tensioned positions prior to loading bulk product into the liner in a container for achieving the synergistic effects.

In yet another summary form of this invention a third sheet member is partially attached to the two sidewalls and the back panel for creating a third pair of diagonal sections of the third sheet member which is suspended between sidewalls and the back panel and for creating yet another overlapping section with the first, second, and third sheet members and with the back panel. This overlapping section of the first, second, and third members with the back panel creates a more rigid back panel to resist bulging.

The planar overlapping sections of the first, second, and third sheet member and the back panel are created as the attachment points of the first pair of diagonal sections of the first sheet member and the second pair of diagonal sections of the second sheet member and the third pair of diagonal sections of the third sheet member are attached to the back panel in spaced apart relationship across the back panel for reinforcing and controlling bulges between attachment points and for bulge prevention of the back panel upon loading the bulk product into the flexible apparatus. Thus this configuration places the maximum amount of material at the highest points of hydrostatic head in the back panel for maximum bulge control. Also these planar overlapping sections once attached may allow the first pair, second pair and third pair of diagonal sections of respective sheet member to thus be pulled upward in vertical and tensioned position prior to receiving the bulk product into the liner in the container and for creating synergistic vector forces for bulge control between the attachment points and across the back panel with the diagonal sections of respective sheet member.

The first, second, and third pair of diagonal sections of the first, second, and third pair of suspended sheet members may in other embodiments have a plurality of apertures across their surfaces for allowing bulk product to move between the suspended sheet members during loading and unloading but utilizing the non-aperture areas of the suspended sheet for creating synergistic vector forces for bulge control of the back panel when bulk product flows into the liner and the container. These apertures may be arranged out of alignment with each other and have a gradient of aperture sizes ranging from larger apertures at the top of the diagonal sections of sheet members to smaller apertures on the bottom diagonal sections of sheet members to allow free movement of bulk product between the diagonal sections of the sheet members in the liner but providing more sheet member material where the hydrostatic forces are the greatest on the bottom of the diagonal sheet members when the vector forces for bulge control are brought into play upon loading the bulk product into the liner in the container.

Another object of this invention is to create a back panel which is formed with the diagonal sheet members having attachment points to the back panel for creating angles of less than 55° with the attachment points to the back panel by their attachment points on the two sidewalls of the sheet members.

Also the diagonal sheet members have lengths between attachment at the back panel and attachment points on the sidewalls for pulling the back panel inward from a planar face perpendicular to the two sidewalls upon filling the liner in the container. In some applications the back panel may be fashioned in a concave manner from the planar space perpendicular to the two sidewalls when the container liner is empty and expand slightly forward to the planar face perpendicular to sidewalls but engages and pulls the diagonal sheet members into tension preventing bulging of the back panel beyond the planar perpendicular surface.

Yet a further object is to provide a flexible liner which is completely self-contained and does not rely on having four or any eye-latches be at any the specific position in container to be able to engage and counter bulge bulkhead pressure against the liner. This is achieved by having at least two flexible straps which are partially attached to the bottom of the flexible liner and having free end portions sufficiently long for finding any available attachment point or eye-latches along the sidewalls of the container to be secured to for positioning the flexible liner in place in the container and then raising the flexible liner into a vertical and tensioned position for activation of it synergistic parts into their vertical and tensioned positions. Thus the object of this invention in part does not rely on the anchoring points of the container to create the restraining anti-bulging force, but relies, in part, on the friction and pressure forces created by the bulk product itself against the synergistic parts of the flexible liner, its diagonal members, straps and the sidewall portions, by pressing them against the container walls and on the flexible straps to give this the liner system a very predictable and good performance characteristic in almost any container system.

The flexible liners of this invention provide such good bulge prevention that the doors to containers may both be open for inspection of the cargo and custom clearance and reclosed. Further by being able to open both doors, without fear of the doors being driven open when unlocked, additional safety bars may be installed for tilted discharge of the container because the back panel bulge is so controlled that metal safety-bars may be inserted in the channel corners of the container.

BRIEF DESCRIPTION OF THE DRAWINGS

Some of the objects and advantages of the present invention having been stated, others will become apparent as the description proceeds when taken in conjunction with the accompanying drawings, in which.

DETAILED DESCRIPTION

The present invention now will be described more fully hereinafter with reference to the accompanying drawings in which one preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

Figure 1:
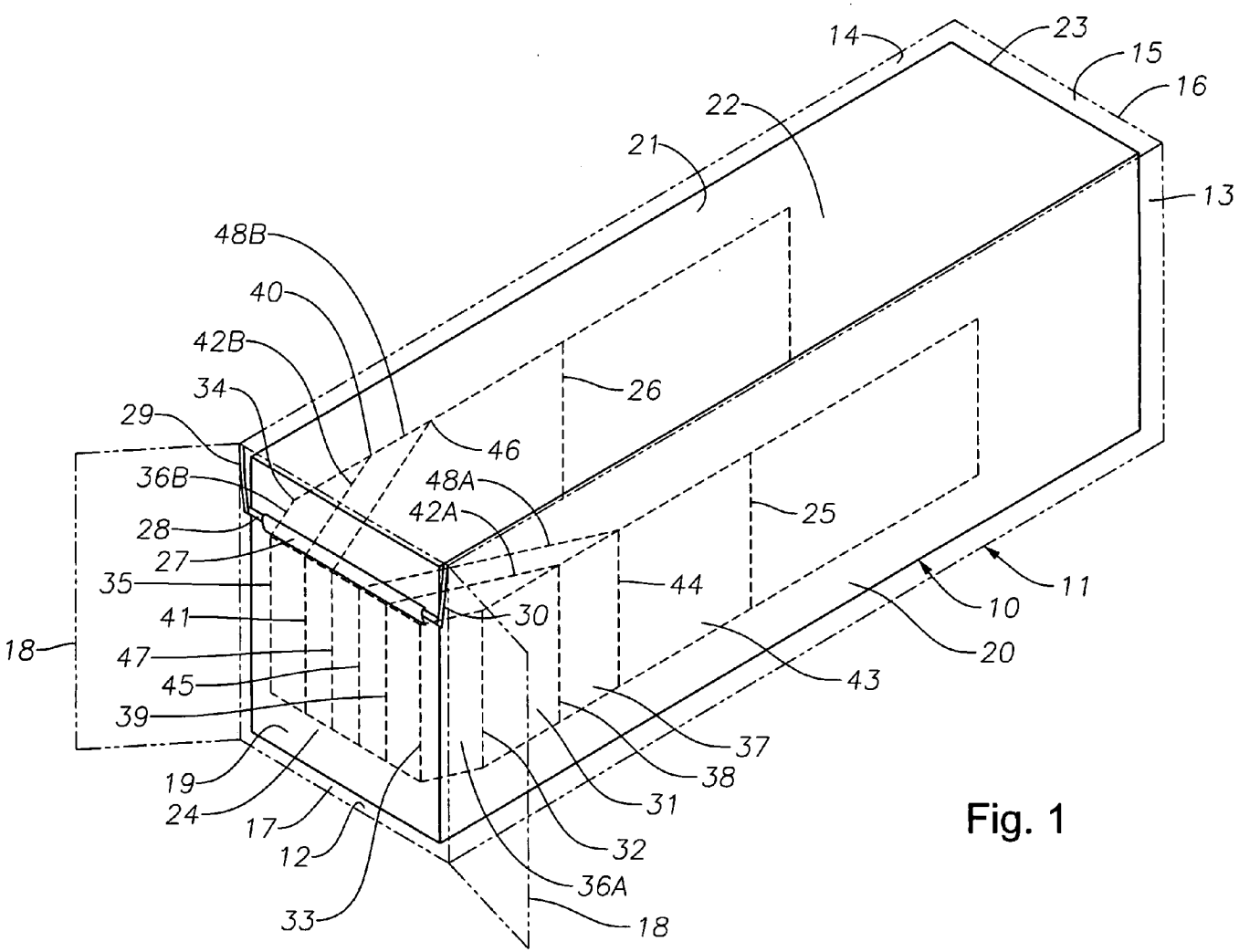
FIG. 1 is a view of the flexible liner of this invention with its internal parts shown in hidden lines and positioned in a container which is shown in phantom lines.

Referring to FIG. 1 in the drawings a flexible liner 10 is shown positioned in a container 11, which is shown in Phantom lines. The container 11 is generally a rectangular shape having a floor 12, two sidewalls 13 and 14 and a top 15. The container 11 will have generally one enclosed end 16 and the other end being a container door end 17 provided with doors 18 which may be opened and closed to provide access to the container 11. FIG. 1 shows the container door end 17, but with the doors 18 being open. The flexible liner 10 shown in FIG. 1 could be a flexible liner 10 which substantially conforms to the shape of the container 11 completely lining the container in which case the flexible liner 10 would have a bottom panel 19, two side panels 20 and 21, a top 22, a closed end 23, and back panel 24 which would face the container door end 17 thus substantially conforming to the shape of the container 11. This flexible liner 10 also has parts which could be used for forming parts of "bulkhead" or "safety sheet" which would stand alone but which in that case it would not line the whole container but only parts of the container 11 such as part of the floor 12, sidewalls 20 and 21 and provide a back panel 24, which would correspond to the container door end 17, and in that case there would be no top 22 and sidewalls would end along sidewalls 20 and 21 at points 25 and 26. The flexible liner 10 of FIG. 1 is also shown having a bottom panel 19, sidewalls 20 and 21 and a back panel 24 having at least one lateral receiving member 27 extending in a line laterally across the back panel 24 between the two sidewalls 20 and 21. Also shown is a support bar 28 disposed and put in place adjacent the one lateral receiving member 27 by sliding support bar 28 into the receiving member 27. The flexible liner 10 of FIG. 1 also in this embodiment has a top 22. Further shown in FIG. 1 is a pair of securing means 29 and 30 used for raising support bar 28 once it is disposed within receiving member 27 of the back panel 24 and for positioning the back panel 24 into vertical and tensioned position.

Figure 2:
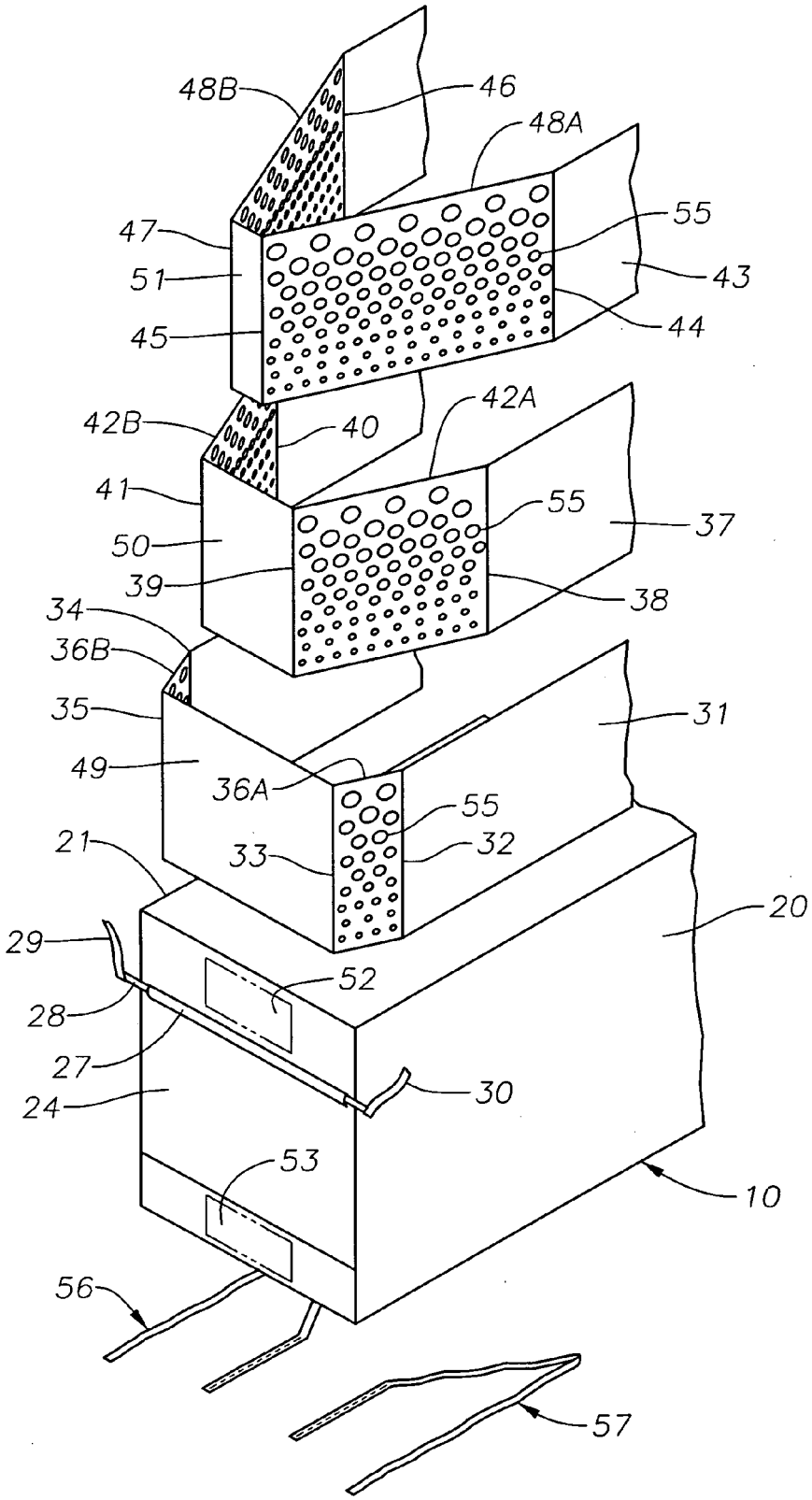
FIG. 2 is an exploded view of the flexible liner with the first sheet, second sheet, and third sheet members in relation to each other and the flexible liner and the support bar and at least the two flexible straps in their relative positions.
Figure 3A:
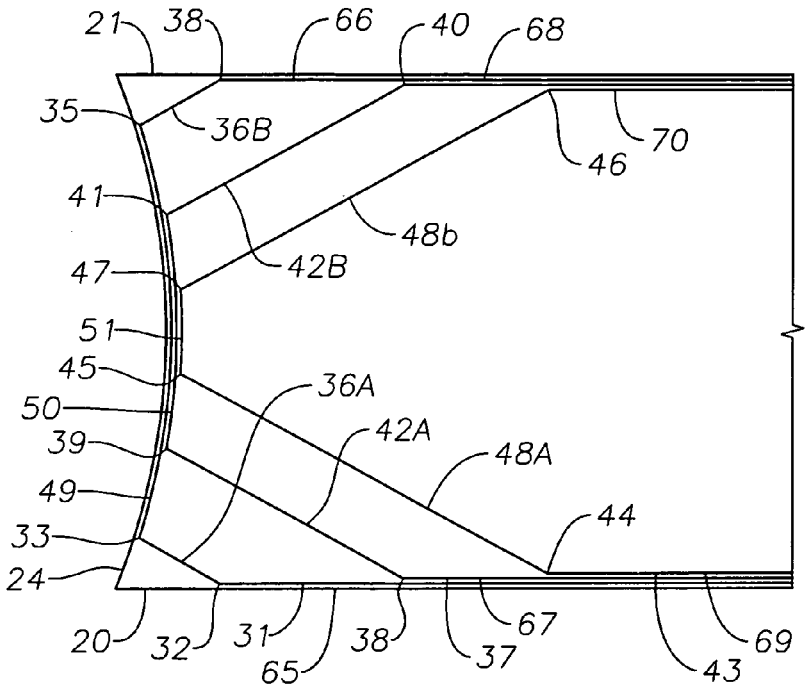
FIG. 3A is a diagrammatic top view of the flexible liner with the top removed showing the flexible liner empty of bulk product and the concaved end panel with planar overlapping sections of the first sheet, second sheet, and third sheet members and the first pair, second pair, and third pair of diagonal sections holding the concaved shape of the back panel and first sheet, second sheet and third sheet members overlapped along the sidewalls before bulk product is added.
Figure 3B:
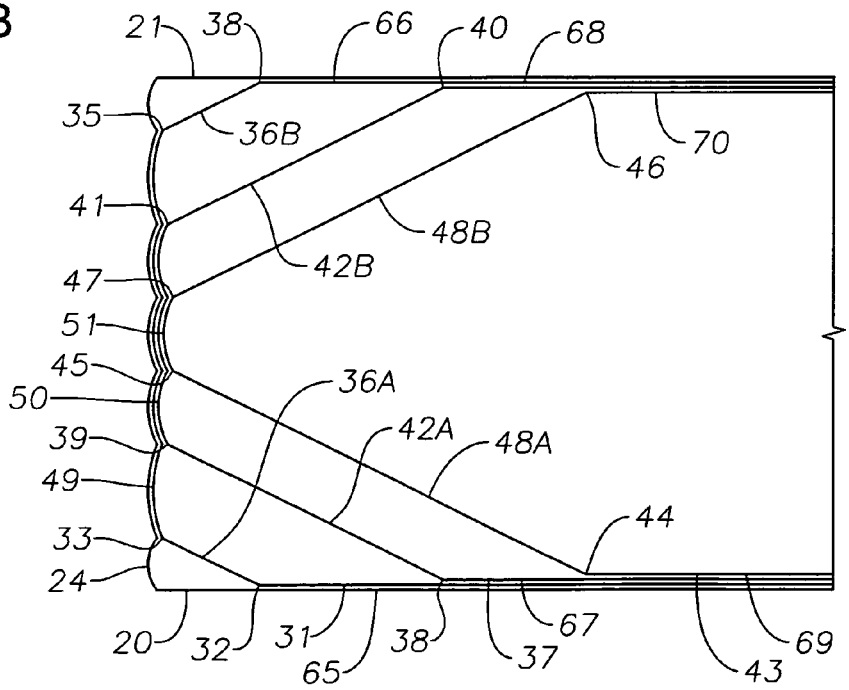
FIG. 3B is a diagrammatic top view of the flexible liner with the top removed showing the flexible liner filled with bulk product and the concaved end panel is pushed out but with planar overlapping sections of the first sheet, second sheet, and third sheet members and the first pair, second pair, and third pair of diagonal sections holding the back panel from bulging beyond a perpendicular plane with the sidewalls of the flexible liner and overlap of the first sheet, second sheet, and third sheet members being pressed to the sidewalls by the bulk product.

The flexible liner 10 in FIG. 1 and FIG. 2 shows a first sheet member 31 being partially attached at an attachment point 32 on one sidewall 20 and at an attachment point 33 to the back panel 24 and attachment point 34 on the other sidewall 21 and at an attachment point 35 to the back panel 24 for creating a first pair of diagonal sections 36A and 36B. Also shown in FIGS. 1 and 2 is a second sheet member 37 being partially attached at an attachment 38 on one sidewall 20 and at an attachment 39 to the back panel 24 and at an attachment point 40 on the other sidewall 21 and at an attachment point 41 to the back panel 24 for creating a second pair of diagonal sections 42A and 42B. Finally, a third sheet member 43 is shown in FIGS. 1 and 2 being partially attached at an attachment 44 on one sidewalls 20 and at an attachment 45 to the back panel 24 and at an attachment point 46 on the other sidewall 21 and attachment 47 to the back panel 24 for creating a third pair of diagonal sections 48A and 48B. In addition to the creation of the first, second, and third pair of diagonal sheets 36A and 36B; 42A and 42B; and 48A and 48B by the attachment points being attached to the back panel 24, these attachment points to the back panel 24 are in spaced apart relationship across the back panel 24 between the two sidewalls 20 and 21 for controlled bulging between the attachment points 33 and 35 of the first sheet member 31; 39 and 41 of the second sheet member 37; and 45 and 47 of the third sheet member 43 and for bulge prevention of the back panel 24 upon loading of the bulk product into the flexible liner 10. These spaced apart relationships across the back panel 24 between the two sidewalls 20 and 21 may be adjusted such as to provide bulge control in the back panel 24 to match the varied hydrostatic head created by the bulk product to be loaded. For example, one of the aims of first sheet member 31 attachment points 33 and 35 to the back panel 24 is to counter the hydrostatic pressure bulge effect of the bulk product at the corners of the back panel 24. The first sheet member 31 attachment points 33 and 35 which are located closest to the corners of the container 11 and its closing back doors 18, therefore are generally located a shorter distance along the back panel 24 from the sidewalls 20 and 21 and are used to control bulging in the back panel 24 between the sidewalls 20 and 21 and attachment points 33 and 35 of the first sheet member and to minimize the amount of bulk product to reach the corner for aiding bulge control. One of the aims of the second sheet member 37 attachment points 39 and 41 to the back panel 24 and to the planar overlapping section 49 of the first sheet member 31 is to counter bulge effects of bulk product near the middle of the back panel 24 and these attachment points 39 and 41 are located further from the corner of the container 11 and its closing back doors 18 and therefore generally a greater distance from the sidewalls 20 and 21 than the attachment point 33 and 35 of first sheet member 31. These attachment points 39 and 41 are further aided in bulge control when the back panel 24 is slightly concave or pulled inward from a planar face perpendicular to the two sidewalls 20 and 21 and therefore allows a higher amount of bulk product to be deposited and still controls the bulge affect. Finally, one of the aims of the third sheet member 43 attachment points 45 and 47 to the back panel 24, as best shown in FIGS. 2, 3A & 3B, is to create the overlapping section 51 with the first sheet member 31 and overlapping section 50 of the second sheet member 37 and to counter bulge effects of bulk product nearest the middle of the back panel 24 and located furthest from the corner of the container 11 and its closing back doors 18 and therefore they are generally located a greater distance from the attachment points 39 and 41 of the second sheet member 37. These attachment points 39 and 41 are also further aided in bulge control when the back panel 24 is slightly concave or pulled inward from a planar face perpendicular to the two sidewalls 20 and 21 and therefore allows a higher amount of bulk product to be deposited against the back panel 24 and still controls the bulge affect.

Figure 6:
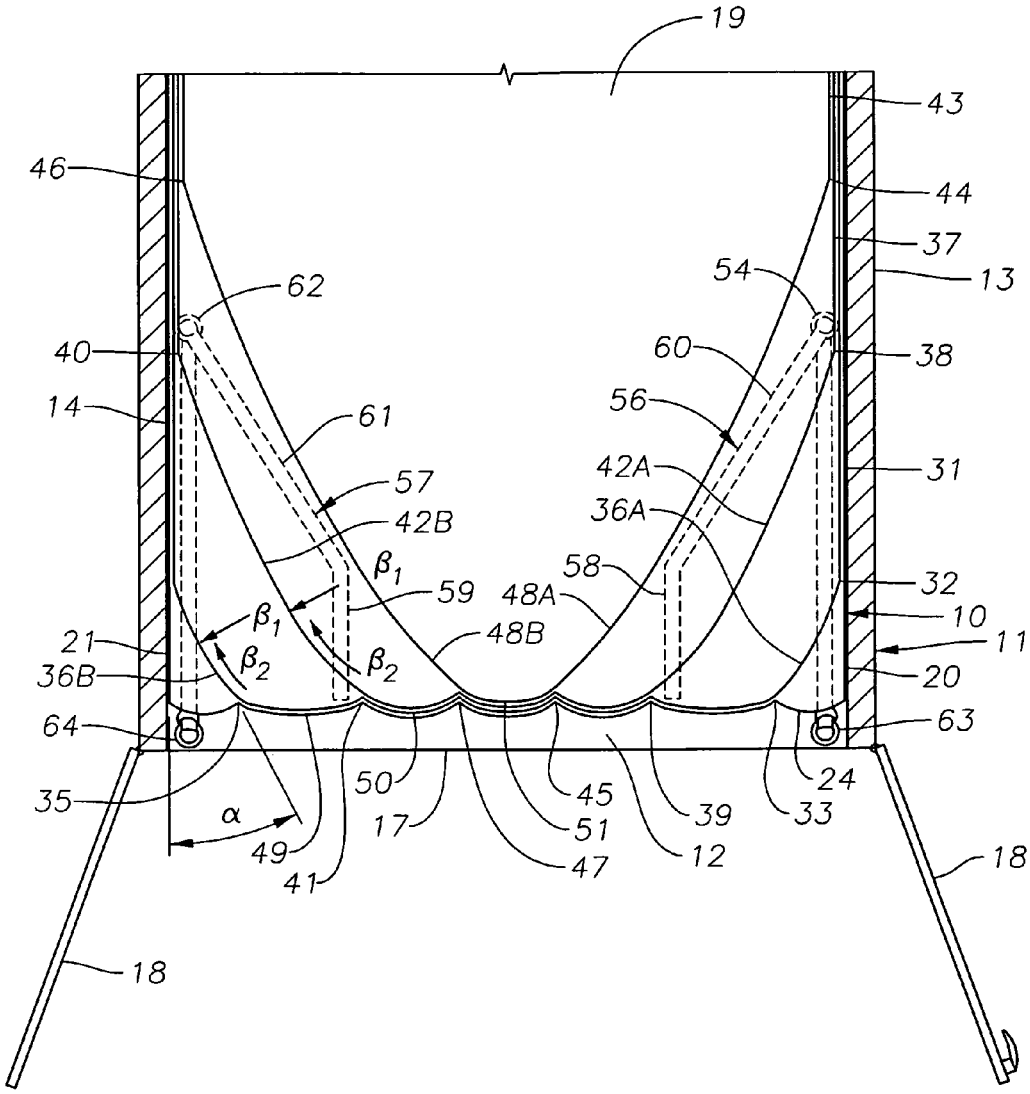
FIG. 6 is a cross sectional view from the top of the flexible liner positioned within a container with the doors open and with the flexible liner loaded with bulk product and diagrammatically showing the range of angles $\alpha$ from 20°-55° created by a diagonal section of a sheet member being attached to the sidewalls and to the back panel and the corresponding vector forces $\beta$1 and $\beta$2 of the hydrostatic head that are believed to help in bulge control and the at least two flexible straps partially attached to said bottom panel and extending back away from the back panel for securing its free ends through an eye latch and then being directed back toward the back panel for being secured to the container

A better understanding of the interrelationship between the first sheet member 31, second sheet member 37 and third sheet member 43 can be had by referring to FIGS. 3A and 3B and FIG. 2 which is an exploded view of the first, second and third sheet members 31, 37, and 43 and the two flexible straps 56 and 57 partially attached at 58 and 59 to the bottom panel 19 of the flexible liner 10, as shown in FIG. 6. From FIGS. 1, 2, 3A, and 3B it can be seen how the first sheet member 31 creates a planar overlapping section 49 of said first sheet member 31 with the back panel 24 for reinforcement of the back panel 24 and how the second sheet member 37 creates a planar overlapping section 50 of the planar overlapping section 49 of the first sheet member 31 with the back panel 24 for reinforcement of the back panel 24. Finally, FIGS. 2, 3A, and 3B show how the third sheet member 43 creates a planar overlapping section 51 of the planar overlapping section 50 of the second sheet member 37 and planar overlapping section 49 of the first sheet member 31 at the back panel 24 for reinforcement of the back panel 24. Also FIGS. 3A and 3B show the planar overlapping sections 65 and 66 of the first sheet member 31 with the sidewalls 20 and 21 and how the second sheet member 43 creates and overlapping sections 67 and 68 of the first sheet member 31 and the sidewalls 20 and 21 and how the third sheet member 43 creates planar overlapping sections 69 and 70 of the second sheet member and the first sheet member and the sidewalls 20 and 21. It will be understood from the discussion and drawing of FIGS. 2, 3A and 3B that the maximum planar overlap on back panel 24 of all sections 49, 50, and 51 occur at the midpoint surface area of back panel 24 to provide maximum and controlled holding force against bulging the back panel 24. Also a controlled holding force is created by the overlapping sections 65, 66, 67, 68, 69, and 70 of the first, second and third sheet members 31, 37 and 43 and the sidewalls 20 and 21 to anchor the flexible liner 10 and its first, second, and third sheet members 31, 37, and 43 into the container 11 when loaded with bulk product. The attachment points in some embodiments are through the first, second, and third sheet members 31, 37, and 43 and into the back panel 24 to form a unitized flexible back panel 24 with maximum holding force at that midpoint on the surface of the back panel 24, which is where the maximum hydrostatic head of the bulk product will occur upon loading the flexible liner 10.

Figure 4:
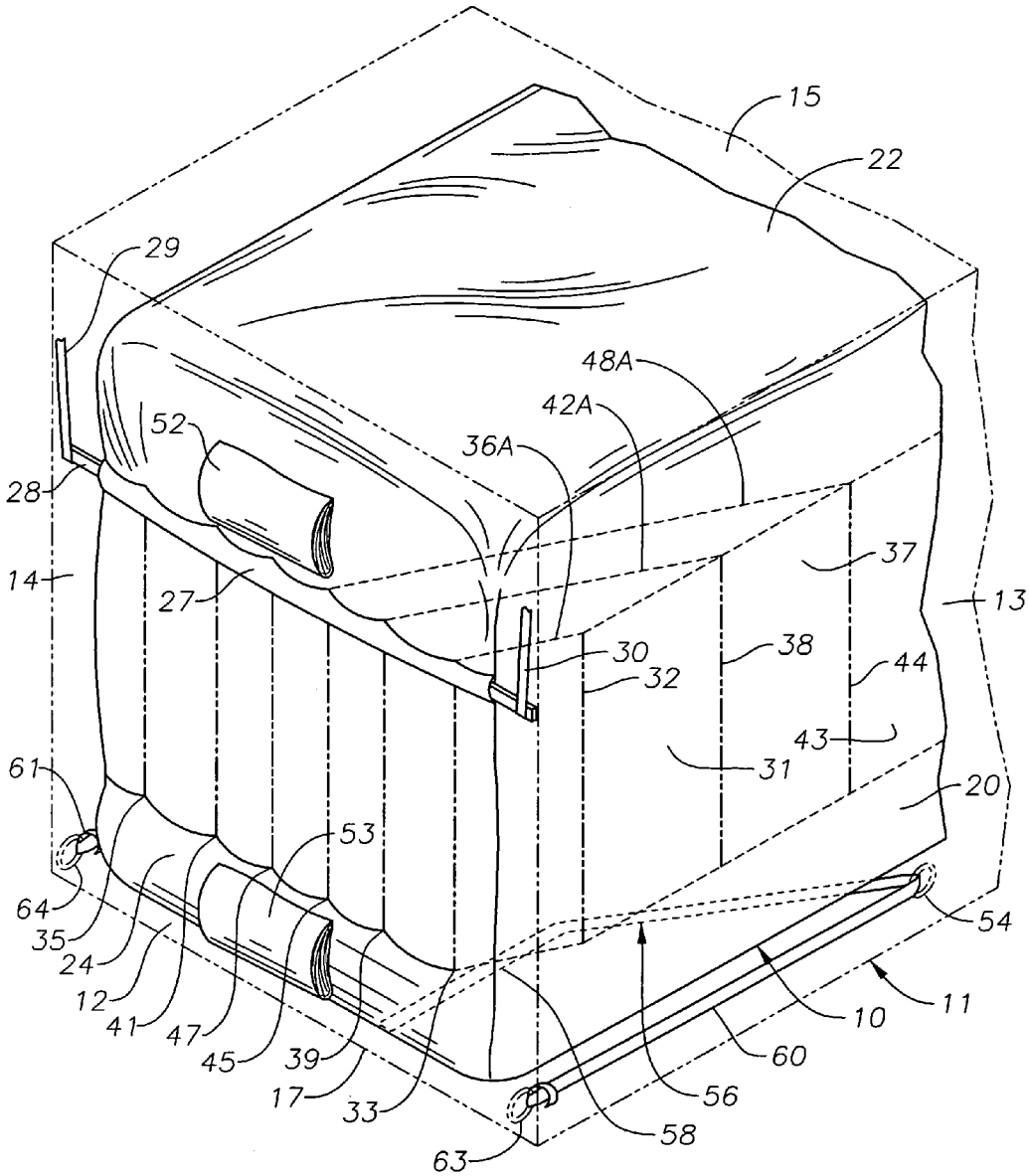
FIG. 4 is a flexible liner of this invention positioned in a container, shown in phantom lines, showing the liner in its vertical and tensioned position with the support bar being placed in the lateral receiving member extending in a line across the back panel between the two sidewalls and one of the two flexible straps extending from under the bottom of the flexible liner to and through an eye latch and back toward the back panel for being secured to the container near the back panel and first sheet, second sheet and third sheet members of one of the diagonal sections on one side being shown in hidden lines.
Figure 5:
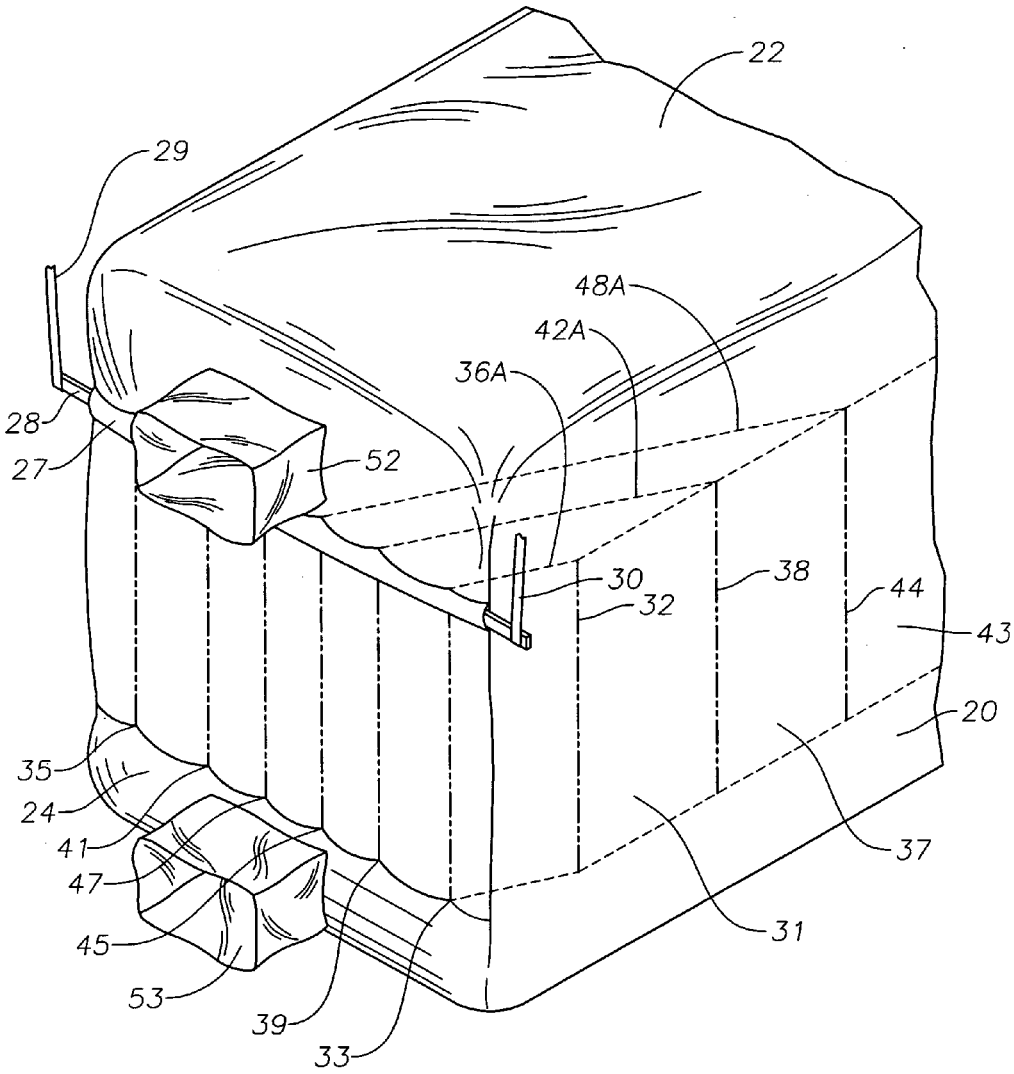
FIG. 5 is a flexible liner in its vertical and tensioned position and with the loading port open and positioned above the support bar placed in the lateral receiving member to receive bulk product and the discharge port open and positioned toward the bottom of the flexible liner for discharge of bulk product.

However while providing maximum and controlled holding force to the midpoint surface area of the back panel 24, the planar overlaps of all sections 49, 50 and 51 can be positioned in some embodiments as shown in FIG. 2 to not go all the way to the top 22 of the flexible liner 10 which leaves space for the bulk product to be loaded into the flexible liner 10 and to not go all the way to the bottom panel 19 for bulk product to be discharged from the flexible liner 10. This midpoint surface area reinforced back panel 24 is especially important in flexible liner 10 which have loading ports 52 and discharge port 53 located in the back panel 24, as shown in FIGS. 2, 4, and 5. While the discharge ports 53 and loading ports 52 make the loading of flexible liner 10 much more efficient for each of the operations of loading and discharging, they also weaken the back panel 24 to allow bulging of the back panel 24 but with the midpoint surface area of the planar overlapping with the back panel 24 shown in FIGS. 2, 4, and 5 the back panel 24 may be controlled against bulging even when discharge ports 53 and loading ports 52 are provided in a back panel 24. Also by having the one lateral receiving member 27 with the support bar 28 positioned above the loading port 52 in the back panel 24, when the support bar 28 is pulled up it reinforces the back panel 24 and hold the loading port 52 open and reenforces the back panel 24 at the loading port 52. The same effect is achieved above the discharge port 53 by transferring the force across the back panel 24 which reinforces the back panel 24 and holds the discharge port 53 open for discharge Also by locating the loading port 52 above the one lateral receiving member 27 into which is inserted the support bar 28, as shown in FIGS. 2, 4, and 5 and having a planar overlapping sections 49, 50, and 51 positioned at the midpoint surface area of the back panel 24 there is no interference with the first pair of diagonal sections 36A and 36B, second pair of diagonal sections 42A and 42B, and third pair of diagonal sections 48A and 48B of the bulk product in loading the bulk product. Likewise by locating the discharge port 53 below the planar overlapping sections 49, 50, and 51 positioned as shown in FIGS. 2, 4, and 5 at the midpoint surface area of the back panel 24 there is no interference with the first pair of diagonals sections 36A and 36B, second pair of diagonal sections 42A and 42B, and third pair of diagonal sections 48A and 48B of the bulk product in discharging the bulk product.

It should be appreciated that in addition to the planar overlapping of all sections 49, 50, and 51 with the area of the back panel 24 to prevent bulging, this planar overlapping also has the synergistic effect of creating a unitized flexible back panel 24 which upon positioning the back panel 24 into vertical and tensioned position also at the same time brings the first pair of diagonal sections 36A and 36B, second pair of diagonal sections 42A and 42B, and third pair of diagonal sections 48A and 48B into vertical and tensioned positions when the support bar 28 is disposed within the one lateral receiving member 27 and raised into position and secured by securing means 29 and 30. This raising of the diagonal sections 36A and 36B; 42A and 42B; and 48A and 48B into vertical and tensioned positions will have a synergistic effect on holding the back panel 24 against bulging created by hydrostatic head of the bulk product loading into the flexible liner 10 as will be discussed later.

These diagonals sections 36A and 36B; 42A and 42B; and 48A and 48B once raised into vertical and tensioned positions will also provide control against bulk product shifting during shipment and tilting discharge. In some embodiments, as shown in FIG. 2, the diagonal sections 36A and 36B; 42A and 42B; and 48A and 48B have apertures 55 located across their surface to allow the bulk product to readily flow in a controlled way between each of the respective diagonal sections. Further, in some embodiments these apertures 55 are located and arranged out of alignment with each other so that when the diagonal sections 36A and 36B; 42A and 42B; and 48A and 48B are raised into vertical and tensioned positions those forces will be transmitted across diagonal sections 36A and 36B; 42A and 42B; and 48A and 48B through the fabric of the sheets to prevent the apertures 55 from creating wave effects in the diagonal sections 36A and 36B; 42A and 42B; and 48A and 48B which would reduce their holding power for bulge control. Also in some embodiments these apertures 55 are arranged in gradients of aperture sizes ranging from larger apertures at the top of the diagonal sections and smaller apertures at the bottom of the diagonal sections to allow for more material to be used in the diagonal sections where the hydrostatic head forces are the greatest on the diagonal sections 36A and 36B; 42A and 42B; and 48A and 48B but allowing bulk product to freely flow through diagonal sections. While a gradient of apertures 55 may exist in the first pair, second pair, and third pair of diagonal sections 36A and 36B; 42A and 42B; and 48A and 48B, it has been found that an aperture ratio of 25 to 45% of apertures to the surface area of the sheet material of first pair, second pair, and third pair of diagonal sections 36A and 36B; 42A and 42B; and 48A and 48B should be maintained for providing sufficient strength against the forces of the hydrostatic head in the diagonal sections 36A and 36B; 42A and 42B; and 48A and 48B.

In some embodiments, as shown in FIG. 2, the back panel 24 may be flat and straight across between the two sidewalls 20 and 21, achieving a planar face perpendicular with the two sidewalls 20 and 21 but in fact in some embodiments the back panel 24, as shown in FIGS. 3A and 3B, is pulled inward between the two sidewalls 20 and 21 to allow the creation of a concave back panel 24, but in either case the lengths of the first pair, second pair, and third pair of diagonal sections 36A and 36B; 42A and 42B; and 48A and 48B of sheet members 31, 37, and 43 between the attachment points to the sidewalls 20 and 21 and the back panel 24 are important to control the bulging of the back panel 24. In the case of flat back panel 24 the lengths of diagonal sections 36A and 36B; 42A and 42B; and 48A and 48B of sheet members 31, 37, and 43 are sufficient for pulling the back panel 24 inward to resist bulging effects of the bulk product loaded into the flexible liner 10. In the case of the concave back panel 24 lengths of diagonal sections 36A and 36B; 42A and 42B; and 48A and 48B of sheet members 31, 37, and 43 are sufficient for pulling the back panel 24 inward from a planar surface perpendicular with the two sidewalls 20, 21 to control the bulging effect as the bulk product is loaded into the flexible container 11 and continues to exert a pulling force against the back panel 24 even as the bulging effect of the bulk product being loaded causes the back panel 24 to move forward toward achieving a planar face perpendicular to the two sidewalls 20 and 21, but not progressing beyond a planar face perpendicular with the two sidewalls 20 and 21.

Also the lengths of the first pair, second pair and third pair diagonal sections 36A and 36B; 42A and 42B; and 48A and 48B, in some embodiments in addition to having critical lengths for exerting a pulling back force against the back panel 24, may have lengths and attachment points for creating angles $\alpha$, as shown in FIG. 6, between first pair, second pair and third pair of diagonal sections 36A and 36B; 42A and 42B; and 48A and 48B of the sheet members 31, 37, and 43 and sidewalls 20 and 21 of from 20°-55°. These a angles help control bulging between the spaced apart attachment points along the back panel 24 and in the back panel 24 in general using vector forces β1 and β2. The range of a angles from 20° to 35° is believed, as shown in FIG. 6, to create vector forces β1 caused by the hydrostatic head of the bulk product pushing against the first pair, second pair and third pair of diagonal sections 36A and 36B; 42A and 42B; and 48A and 48B which creates a pulling back force β2 because the first pair, second pair, and third pair of diagonal sections 36A and 36B; 42A and 42B; and 48A and 48B are attached to the sidewalls 20 and 21 and the first sheet member 31, second sheet member 37 and third sheet member 43 extend back in overlapping relationship 65, 66, 67, 68, 69, and 70 with the sidewalls 20 and 21 as shown in FIGS. 3A and 3B and are held against the container 11 walls 13 and 14 by the bulk product but the attachment points 33, 35, 39, 41, 45, and 47 to the back panel 24 of the first pair, second pair and third pair of diagonal sections 36A and 36B; 42A and 42B; and 48A and 48B are free to pull back the back panel 24 because of the hydrostatic head created vector force β1 being applied over the 20° to 55° of a angles created over the first pair, second pair, and third pair of diagonal sections 36A and 36B; 42A and 42B; and 48A and 48B of the sheet members 31, 37, and 43.

To better understand how the creation of the α angles; the spaced apart relationship of the attachment points to and along the back panel 24, the lengths of first pair, second pair, third pair of diagonal sections lengths of sections 36A and 36B; 42A and 42B; and 48A and 48B of the sheet members 31, 37, and 43 assist in holding back the back panel 24 against hydrostatic head of the bulk product, are all interrelated to produce a novel flexible liner 10 when the back panel 24 with the one support bar 28 is inserted in the one lateral receiving member 27 of the back panel 24 and raised into vertical and tensioned position creates a synergistic effect of the invention of this flexible liner 10, an example of one embodiment may be helpful. To better understand an example embodiment, one must first understand the geometry of some of the parts of this flexible liner 10 and how they are interrelated. For example if the attachment point 33 of the first sheet member 31 and the back panel 24 is located 25.7 cm on the back panel 24 from the sidewall 20 and the attachment point 32 of the first sheet member 31 to the sidewall 20 is located 78.5 cm along the sidewalls 20 from the back panel 24 then an angle of about 20° is created between the sidewalls 20 and one of the first pair of diagonal sections 36A. But if the attachment point 33 remained at the same location on the back panel 24 and attachment point 32 of the first sheet member 31 with the sidewall 20 is located 33.5 cm along the sidewall 20 from the back panel 24 then an angle is created of about 34°. In the case of the geometry for the second sheet member 37 by way of example if the attachment point 39 of the second sheet member 37 and the back panel 24 is located 28.2 cm from the attachment point 33 of the first sheet member 31 on the back panel 24 from the sidewalls 20 and attachment point 38 to sidewall 20 of the second sheet member 37 is located 162.5 cm along sidewalls 20 and the back panel 24 an angle is created of about 20° between one of the diagonal panels of the second sheet member 37 and the back panel 24. But however if the attachment point 39 remained at the same location on the back panel 24 and the attachment point 38 to sidewall 20 of the second sheet member 37 is located 117.5 cm along sidewalls 20 and the back panel 24 an angle is created of about 34° between one of the diagonal panels of the second sheet member 37 and the back panel 24. Finally, in the case of the geometry for the third sheet member 43 by way of example if its attachment point 45 of the second sheet member 37 to the back panel 24 is located 21.2 cm from the attachment point 39 of the third sheet member 43 on the back panel 24 and attachment point 46 of the third sheet member 43 the sidewalls 20 is located 224 cm along the sidewall 20 and back from back panel 24 an angle is created of about 20° between one of the diagonal panels of the third sheet member 43 and the back panel 24. Finally, however, if the attachment point 45 remained at the same location on the back panel 24 and the attachment 46 to sidewall 20 of the third sheet member 43 is located 179 cm along sidewalls 20 and the back panel 24 an angle is created of about 34° between one of the diagonal panels of the third sheet member 43 and the back panel 24.

Figure 7:
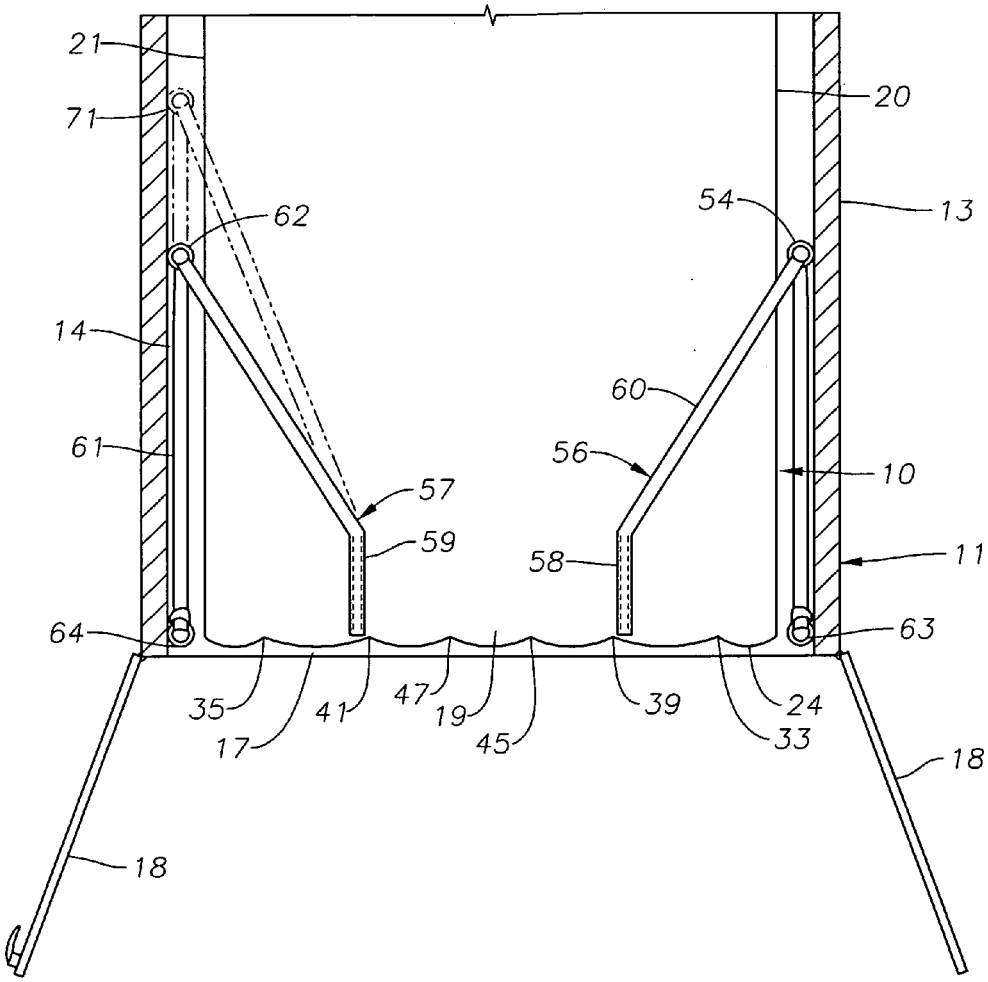
FIG. 7 shows a bottom view of a loaded flexible liner having at least two flexible straps partially attached to the bottom panel and extending back away from the back panel between the two sidewalls and having free ends in one position for securing the flexible liner to the container and showing, in phantom lines, a second position for securing the flexible liner to an eye latch located in a different position along the walls of the container.

Also to assist those skilled in the art in understanding how these interrelated parts produce the novel flexible liner 10 an over simplified description of one embodiment of a method for loading bulk product into the flexible liner 10 will be set out. The loading embodiment method would commence with placing the flexible liner 10 in a container 11 and unfolding it in a conventional manner but with the back panel 24 facing the container door end 17 which puts the two straps 56 and 57 which are partially attached along portions 58 and 59 to the bottom panel 19 of the flexible liner 10 on the floor 12 of the container 11. Then the free end portions 60 and 61 of the two straps 56 and 57 are respectively routed through attachment points/eye-latches 54 and 62 of the container 11 as shown in FIGS. 6 and 7 and returned back toward the back panel 24 along sidewalls 13 and 14 of the container 11 between the sidewalls 13 and 14 of the container 11 and the sidewalls 20 and 21 of the flexible liner 10 for being secured to the container 11 at attachment points 63 and 64. It should be understood that the free ends 60 and 61 can be routed through any attachment points/eye-latches like those at attachment points 63 and 64 shown in FIG. 7, but it would be preferred that an attachment point/eye-latches used for attachment be located such that the free ends 60 and 61 would form a 90° or greater angle from their attached portions 58 and 59 to bottom panel 12 of liner 10 to create a pulling back force on the bottom 19 of the flexible liner 10 to assist in holding the liner 10 in place in the container 11. For example, in FIG. 7 attachment point 71 shows a second option. The routing back of free end portion 60 and 61 through attachment points/eye-latches 54 and 62 and attached at attachment points 63 and 64 will provide a pulling back force on the back panel 24 when the flexible liner 10 is being loaded with bulk product which creates the hydrostatic head throughout the back panel 24 and walls of the flexible liner 10. Also the hydrostatic head of the bulk product on the bottom panel 19 and two straps 56 and 57 will provide an anchoring effect for the flexible liner 10 and the two straps 56 and 57. Then the support bar 28 is inserted into the one lateral receiving member 27 which extends in a line laterally across the back panel 24 between the two sides 20 and 21. Next the securing members 29 and 30 are used to raise up the one support bar 28 for positioning the back panel 24 into a vertical and tensioned position. The straps 56 and 57 which are partially attached along portions 58 and 59 to the bottom panel 19 of the flexible liner 10 provide a holding back against the forces exerted by the support bar 28 when the securing members 29 and 30 are raised to further aid in vertical and tensioned positioning of the back panel 24. As has been described above, the back panel 24 is formed into a unitized flexible member, because it has the first sheet member 31 with the first pair of diagonal sections 36A and 36B attached to sidewalls 20 and 21 and to the back panel 24 for creating a planar overlap section 49 of the first sheet member 31; second sheet member 37 with the second pair of diagonal sections 42A and 42B attached to the sidewalls 20 and 21 and to the back panel 24 for creating a planar overlap section 50 of the second sheet member 37 with overlap section 49 of the first sheet member 31 and the back panel 24; and third sheet member 43 with the third pair of diagonal sections 48A and 48B attached to the sidewalls 20 and 21 and the back panel 24 for creating a planar overlap section 51 of the second sheet member 37 and overlap section 50 of the second sheet member 37 with overlap section 49 of the first sheet member 31 and the back panel 24 joined to it. So as a unitized flexible member, when the back panel 24 is raised up by support bar 28 and secured by securing members 29 and 30 the first pair of diagonal sections 36A and 36B; second pair of diagonal sections 42A and 42B; and third pair of diagonal sections 48A and 48B are brought into vertical and tensioned positions in the flexible liner 10. This positioning into vertical and tensioned positions means that the α angles of the first, second, and third pair of diagonal sections 36A and 36B; 42A and 42B; and 48A and 48B are set in place which means that these diagonal sections with apertures 55 in them are fully stretched between sidewalls 20 and 21 and the back panel 24. Because the lengths of the first, second, and third pair of diagonal sections 36A and 36B; 42A and 42; and 48A and 48B between sidewalls 20 and 21 and to the back panel 24 are slightly shorter a pulling back of the back panel 24 inward or concaved from a planar face which would be perpendicular to sidewalls 20 and 21 occurs. Also because the first, second, and third pair of diagonal sections 36A and 36B; 42A and 42B; and 48A and 48B are attached in spaced apart relation across the back panel 24 the pulling back of the back panel 24 inward or concaved is precisely controlled. In an embodiment using straps 56 and 57 which are attached to the bottom panel 19 but have a pair of free end portions 60 and 61 which are secured to the container 11 for holding the flexible liner 10 in place, further aid in back panel 24 being drawn into vertical and tensioned positions. Referring to FIGS. 4 and 5, next the loading port 52 is open and bulk product is delivered to flexible liner 10. It should be appreciated by those skilled in the art that the positioning of the loading port 52 above the support bar 28 and in most embodiments above the first, second, and third pair of diagonal sections 36A and 36B; 42A and 42B: and 48A and 48B allows for free-flowing of bulk product into the flexible liner 10 without interference with the loading. Further the loading port 52 is positioned such that the bulk product is evenly distributed between the third pair of diagonal sections 48A and 48B and allows it to flow freely into and through the apertures 55 in the third, second, and first diagonal sections 36A and 36B; 42A and 42B; and 48A and 48B to create the forces of hydrostatic head to be controlled and used, as discussed above, for bulge control in the back panel 24 between the points of attachment 33 and 35 of first sheet member 31; points of attachment 39 and 41 of second sheet member 37, and points of attachment 45 and 47 of third sheet member 43 spaced across the back panel 24. The straps 56 and 57 also utilize the hydrostatic head to anchor and hold the flexible liner 10 as it is loaded with bulk product.

In the drawings and specification, there have been disclosed typical preferred embodiments of the invention and, although specific terms are employed, they are used in a generic and descriptive sense only and not for the purpose of limitation, the scope of the invention being set forth in the following claims.

The invention claimed is:

1. A flexible apparatus for transporting and storing bulk products within a container comprising;

a. a liner having a bottom panel, two sidewalls, and a back panel having at least one lateral receiving member extending in a line laterally across said back panel between said two sidewalls;

b. a first sheet member being partially attached to said two sidewalls and to said back panel in spaced apart relationship across said back panel for creating a first pair of diagonal sections of said first sheet member suspended between one sidewall and said back panel and said other sidewall and said back panel and for creating a planar overlapping section of said first sheet member and with said back panel for controlled bulging between said attachment points and for bulge prevention of said back panel;

c. a second sheet member being partially attached to said two sidewalls and to said back panel in spaced apart relationship across said back panel for creating a second pair of diagonal sections of said second sheet member suspended between one sidewall and said back panel and said other sidewall and said back panel and for creating a planar overlapping section of said second sheet member with said planar overlapping section of said first sheet member and with said back panel for controlled bulging between said attachment points and for bulge prevention of said back panel;

d. a third sheet member being partially attached to said two sidewalls and to said back panel in spaced apart relationship across said back panel for creating a third pair of diagonal sections of said third sheet member suspended between said one sidewall and said back panel and said other sidewall and said back panel in spaced apart relationship across said back panel for creating a planar over-lapping section of said third sheet member with said planar overlapping section of said second sheet member and with said overlapping section of said first sheet member and with said back panel for controlled bulging, between said attachment points and for bulge prevention of said back panel;

e. at least one support bar functionally disposed adjacent said at least one lateral receiving, member of said back panel; and f. at least a pair of securing means for raising up said at least one support bar functionally disposed adjacent said at least one lateral receiving member of said back panel for positioning said first sheet member and said first pair of diagonal sections of said first sheet member into vertical and tensioned positions and said second sheet member and said second pair of diagonal sections of said second sheet member into vertical and tensioned positions and said third sheet member and said third pair of diagonal sections of said third sheet member into vertical and tensioned positions and said back panel into vertical and tensioned position for positioning first, second, and third sheet member attachment points to said back panel into spaced apart relationship and for allowing, securing of said at least one support bar functionally disposed adjacent said at least one lateral receiving member of said back panel, to said container.

2. The flexible apparatus of claim 1 wherein said attachment points created in spaced apart relationship in said planar overlapping section of said third sheet member, said second sheet member, said first sheet member and said back panel further comprising;

a. first sheet member attachment points to said back panel in spaced apart relationship located a distance sufficient for controlling, bulges in said back panel between said sidewalls and first sheet member attachment points and for controlling the amount of bulk product received between said first pair of diagonal sections of said first sheet members and said sidewalls, b. second sheet member attachment points to said first sheet member and said back panel in spaced apart relationship located a distance sufficient for controlling bulges in said back panel between said first pair of diagonal sections of said first sheet member and said second pair of diagonal sections of said second sheet member along said back panel, and c. third sheet member attachment points to said second sheet member, first sheet member and said back panel in spaced apart relationship located a distance sufficient for controlling bulges in said back panel between said second pair of diagonal sections of said second sheet member and said third pair of diagonal sections of said third sheet member and between said third pair of said diagonal sections of said third sheet members along said back panel.

3. The flexible apparatus of claim 2 wherein said first pair of diagonal sections of first sheet member further comprises;

a. a plurality of apertures in said first pair of diagonal sections of said first sheet member.

4. The flexible apparatus of claim 3 wherein said second pair of diagonal sections of said second sheet member further comprises;

a. a plurality of apertures in said second pair of diagonal sections of said second sheet member.

5. The flexible apparatus of claim 4 wherein said third pair of diagonals sections of said third sheet member further comprises;

a. a plurality of apertures in said third pair of diagonal sections of said third sheet member.

6. The flexible apparatus of claim 5 wherein said plurality of apertures in said first pair of diagonal sections of said first sheet member and said plurality of apertures in said second pair of diagonal sections of said second sheet member; and said third pair of diagonals sections of said third sheet member further comprising:

a. a plurality of apertures in said first pair of diagonal sections of said first sheet member which are arranged out of alignment with each other;

b. a plurality of apertures in said second pair of diagonal sections of said second sheet member which are arranged out of alignment with each other; and c. a plurality of apertures in said third pair of diagonal sections of said third sheet member which are arranged out of alignment with each other.

7. The flexible apparatus of claim 6 wherein said plurality of apertures in said first, pair of diagonal sections of said first sheet member which are arranged out of alignment with each other and said second pair of diagonal sections of said second sheet member which are arranged out of alignment with each other; and said third pair of diagonals sections of said third sheet member which are arranged out of alignment with each other further comprising:

a. a gradient of apertures sizes ranging from larger apertures in said first pair of diagonal sections of said first sheet member furthest away from said bottom panel to smaller apertures in said first pair of diagonal sections of said first sheet member closest to said bottom panel, b. a gradient of apertures sizes ranging from larger apertures in said second pair of diagonal sections of said second sheet member furthest away from said bottom panel to smaller apertures in said second pair of diagonal sections of said second sheet member closest to said bottom panel; and c. a gradient of apertures sizes ranging from larger apertures in said third pair of diagonal sections of said third sheet member furthest away from said bottom panel to smaller apertures in said third pair of diagonal sections of said third sheet member closest to said bottom panel.

8. The flexible apparatus of claim 7 wherein said first sheet member said second sheet member, said third sheet member partially attached to said two sidewalls further comprising:

a. attachment points to said two sidewalls of said first sheet member along said two sidewalls from said back panel and to said back panel from said two sidewalls along said back panel a sufficient distance for creating an angle of from 20° to 55° between said first pair of diagonal sections of said first sheet member and said sidewalls;

b. attachment points to said sidewalls of said second sheet member along said two sidewalls from said back panel and to said back panel from said two sidewalls along said back panel a sufficient distance for creating an angle of from 20° to 55° between said second pair of diagonal sections of said second sheet member and said sidewalls; and c. attachment points to said sidewalls of said third sheet member along said two sidewalls from said back panel and to said back panel from said two sidewalls along said back panel a sufficient distance for creating an angle of from 20° to 55° between said third pair of diagonal sections of said third sheet member and said sidewalls.

9. The flexible apparatus of claim 8 wherein said first pair of diagonals of said first sheet member, said second pair of diagonals of said second sheet member, and said third pair of diagonals of said third sheet member partially attached to said two sidewalls further comprising:

a. lengths of said first pair of diagonals between said attachment points to said two sidewalls of said first sheet member and said attachment points to said back panel of said first sheet member for pulling said back panel inward from a planar face perpendicular to said two sidewalls;

b. lengths of said second pair of diagonals between said attachment points to said two sidewalls of said second sheet member and said attachment points to said back panel of said second sheet member for pulling said back panel inward from a planar face perpendicular to said two sidewalls; and c. lengths of said third pair of diagonals between said attachment points to said two sidewalls of said third sheet member and said attachment points to said back panel of said third sheet member for pulling; said back panel inward from a planar face perpendicular to said two sidewalls.

10. The flexible apparatus of claim 9 wherein said gradient of aperture sizes ranging from larger apertures to smaller apertures in said first pair of diagonal sections of said first sheet members; said gradient of aperture sizes ranging from larger apertures to smaller apertures in said second pair of diagonal sections of said second sheet member; and said gradient of aperture sizes ranging from larger apertures to smaller apertures in said third pair of diagonal sections of said third sheet member further comprising:

a. apertures in said first pair of diagonal sections of said first sheet member being in a ratio of 25% to 45% of said first pair of diagonal sections of said first sheet member;

b. apertures in said second pair of diagonal sections of said second sheet member being in a ratio of 25% to 45% of said second pair of diagonal sections of said second sheet member; and c. apertures in said third pair of diagonal sections of said third sheet member being in a ratio of 25% to 45% of said third pair of diagonal sections of said third sheet member.

11. The flexible apparatus of claim 10 further comprising;

a. at least two flexible straps partially attached to said bottom panel of said flexible apparatus and extending away from said back panel and located between said two sidewalls and having free end portions for securing said at least two flexible straps attached to said bottom panel of said flexible apparatus to said container.

12. The flexible apparatus of claim 11 wherein said free end portions of said straps further comprising;

a. lengths of said free end portions sufficient for finding an available attachment point along said sidewalls of said container at 90° or greater angle from said straps attachment points furthest back from said back panel and for allowing the return of said straps back toward said back panel for securing said free end portions to said container.

13. The flexible apparatus of claim 12 further comprising:

a. a loading port through said back panel and located above said at least one lateral receiving member extending laterally across said back panel for loading bulk product there through; and b. a discharge port through said back panel and located toward said bottom of said back panel for discharging bulk product there through.

14. The flexible apparatus of claim 13 wherein said planar overlapping sections of said first sheet member, second sheet member and third sheet member with said back panel further comprises;

a. attachment points of each of said first pair of diagonal sections, second pair of diagonal sections, and third diagonal sections to said back panel in spaced apart relationship across said back panel and located between said loading port and said discharge pert on said back panel.

15. The flexible apparatus of claim 14 wherein said first pair of diagonal sections, second pair of diagonal sections, and said third pair of diagonal sections further comprises:

a. descending edges on the top side of said first pair of diagonal sections, second pair of diagonal sections, and third pair of diagonal sections from said attachment points to said sidewalls to said back panel attachment points for creating said overlapping sections of said first, second, and third sheet members with said back panel between said loading port and said discharge port on said back panel, and b. ascending edges on the bottom side of said first pair of diagonal sections, second pair of diagonal sections, and third pair of diagonal sections from said attachment points to said sidewalls to said back panel attachment points for creating said overlapping sections of said first, second, and third sheet members with said back panel between said loading port and said discharge port on said back panel.

16. A flexible apparatus for transporting and storing bulk products within a container comprising:

a. a liner having a bottom panel, two sidewalls, and a back panel having at least one lateral receiving member extending in a line laterally across said back panel between said two sidewalls;

b. a first sheet member being partially attached to said two sidewalls and to said back panel at a distance sufficient from said back panel to each of said sidewalls for creating a first pair of diagonal sections of said first sheet member at an angle of from 20° to 55° between said first pair of diagonal sections of said first sheet member suspended between said one sidewall and said other sidewall and said back panel and for creating a planar overlapping section of said first sheet member and with said back panel and extending back from where said first sheet member is attached to said two sidewalls parallel along said two sidewalls a distance sufficient for holding said first sheet member against said two sidewalls when bulk product is loaded;

c. a second sheet member being partially attached to said two sidewalls and to said back panel a distance sufficient from said back panel to each of said sidewalls for creating a second pair of diagonal sections of said second sheet member at an angle of from 20° to 55° between said second pair of diagonal sections of said second sheet member suspended between one sidewall and said other sidewall and said back panel and for creating a planar overlapping section of said second sheet member with said planar overlapping section of said first sheet member and with said back panel and extending back from where said second sheet member is attached to said first sheet member and two sidewalls parallel along said first sheet member and said two sidewalls a distance sufficient for holding said first and second sheet members against said two sidewalls when bulk product is loaded;

d. a third sheet member being partially attached to said two sidewalls and to said back panel a distance sufficient from said back panel to each of said sidewalls for creating a third pair of diagonal sections of said third sheet member at an angle of from 20° to 55° between said third pair of diagonal sections of said third sheet member suspended between one sidewall and said other sidewall and said back panel for creating a planar over-lapping section of said third sheet member with said planar overlapping section of said second sheet member and with said overlapping section of said first sheet member and with said back panel extending back from where said third sheet member is attached to said first and second sheet members and two sidewalls parallel along said first and second sheet members and said two sidewalls a distance sufficient for holding said first, second, and third sheet members against said two sidewalls when bulk product is loaded;

e. at least one support bar functionally disposed adjacent said at least one lateral receiving member of said back panel; and f. at least a pair of securing means for raising up said at least one support bar functionally disposed adjacent said at least one lateral receiving member of said back panel for positioning said first sheet member and said first pair of diagonal sections of said first sheet member into vertical and tensioned positions and said second sheet member and said second pair of diagonal sections of said second sheet member into vertical and tensioned positions and said back panel into vertical and tensioned position and for allowing securing of said at least one support bar functionally disposed adjacent said at least one lateral receiving member of said back panel to said container.

17. The flexible apparatus of claim 16 wherein said planar overlapping section of said third sheet member, said second sheet member, said first sheet member and said back panel created by attachment points for each of said first pair of diagonal sections of said first sheet member and second pair of diagonal sections of said second sheet member and third pair of diagonal sections of said third sheet member to said back panel further comprising;

a. attachment points located in spaced apart relationship across said back panel for controlled bulging between said attachment points and for bulge prevention of said back panel.

18. The flexible apparatus of claim 17 wherein said attachment points created in spaced apart relationship in said planar overlapping section of said third sheet member, said second sheet member, said first sheet member and said back panel further comprising;

a. first sheet member attachment points to said back panel located in spaced apart relationship a distance apart for controlling bulges between said sidewalls and said first pair of diagonals of said first sheet member along said back panel and for minimizing the amount of bulk product received between said first pair of diagonal sections of said first sheet member and said sidewalls, b. second sheet member attachment points to said first sheet member and said back panel in spaced apart relationship a distance apart for controlling bulges between said first pair of diagonal sections of said first sheet member and said second pair of diagonal sections of said second sheet member along said back panel, and c. third sheet member attachment points to said second sheet member, first sheet member and said back panel in spaced apart relationship a distance for controlling bulges between said second pair of diagonal sections of said second sheet member and said third pair of diagonal sections of said third sheet member and between said pair of said third pair of diagonal sections of said third sheet member along said back panel.

19. The flexible apparatus of claim 18 wherein said first pair of diagonal sections of first sheet member further comprises;

a. a plurality of apertures in said first pair of diagonal sections of said first sheet member.

20. The flexible apparatus of claim 19 wherein said second pair of diagonal sections of said second sheet member further comprises;

a. a plurality of apertures in said second pair of diagonal sections of said second sheet member.

21. The flexible apparatus of claim 20 wherein said third pair of diagonals sections of said third sheet member further comprises;

a. a plurality of apertures in said third pair of diagonal sections of said third sheet member.

22. The flexible apparatus of claim 21 wherein said plurality of apertures in said first pair of diagonal sections of said first sheet member and said plurality of apertures in said second pair of diagonal sections of said second sheet member; and said third pair of diagonals sections of said third sheet member further comprising:

a. a plurality of apertures in said first pair of diagonal sections of said first sheet member which are arranged out of alignment with each other;

b. a plurality of apertures in said second pair of diagonal sections of said second sheet member which are arranged out of alignment with each other; and c. a plurality of apertures in said third pair of diagonal sections of said third sheet member which are arranged out of alignment with each other.

23. The flexible apparatus of claim 22 wherein said plurality of apertures in said first pair of diagonal sections of said first sheet member which are arranged out of alignment with each other and said second pair of diagonal sections of said second sheet member which are arranged out of alignment with each other; and said third pair of diagonals sections of said third sheet member which are arranged out of alignment with each other further comprising:

a. a gradient of apertures sizes ranging from larger apertures in said first pair of diagonal sections of said first sheet member furthest away from said bottom panel to smaller apertures in said first pair of diagonal sections of said first sheet member closest to said bottom panel;

b. a gradient of apertures sizes ranging from larger apertures in said second pair of diagonal sections of said second sheet member furthest away from said bottom panel to smaller apertures in said second pair of diagonal sections of said second sheet member closest to said bottom panel; and c. a gradient of apertures sizes ranging from larger apertures in said third pair of diagonal sections of said third sheet member furthest away from said bottom panel to smaller apertures in said third pair of diagonal sections of said third sheet member closest to said bottom panel.

24. The flexible apparatus of claim 23 wherein said first pair of diagonals of said first sheet member, said second pair of diagonals of said second sheet member, and said third pair of diagonals of said third sheet member partially attached to said two sidewalls and said back panel further comprising:

a. lengths of said first pair of diagonals between said attachment points to said two sidewalls of said first sheet member and said attachment points to said back panel of said first sheet member for pulling said back panel inward from a planar face perpendicular to said two sidewalls;

b. lengths of said second pair of diagonals between said attachment points to said two sidewalls of said second sheet member and said attachment points to said back panel of said second sheet member for pulling, said back panel inward from a planar face perpendicular to said two sidewalls; and c. lengths of said third pair of diagonals between said attachment points to said two sidewalls of said third sheet member and said attachment points to said back panel of said third sheet member for pulling said back panel inward from a planar face perpendicular to said two sidewalls.

25. The flexible apparatus of claim 24 wherein said gradient of aperture sizes ranging from larger apertures to smaller apertures in said first pair of diagonal sections of said first sheet members; said gradient of aperture sizes ranging from larger apertures to smaller apertures in said second pair of diagonal sections of said second sheet member; and said gradient of aperture sizes ranging from larger apertures to smaller apertures in said third pair of diagonal sections of said third sheet member further comprising:

a. apertures in said first pair of diagonal sections of said first sheet member being in a ratio of 25% to 45% of said first pair of diagonal sections of said first sheet member;

b. apertures in said second pair of diagonal sections of said second sheet member being in a ratio of 25% to 45% of said second pair of diagonal sections of said second sheet member; and c. apertures in said third pair of diagonal sections of said third sheet member being in a ratio of 25% to 45% of said third pair of diagonal sections of said third sheet member.

26. The flexible apparatus of claim 25 further comprising;

a. at least two flexible straps partially attached to said bottom panel of said flexible apparatus and extending away from said back panel, and located between said two sidewalls and having free end portions for securing said at least two flexible straps attached to said bottom panel of said flexible apparatus to said container.

27. The flexible apparatus of claim 26 wherein said free end portions of said straps further comprising;

a. lengths of said free end portions sufficient for finding an available attachment: point along said sidewalls of said container at 90° or greater angle from said straps attachment points furthest back from said back panel and for allowing the return of said straps back toward said back panel for securing said free end portions to said container.

28. The flexible apparatus of claim 27 further comprising:

a. a loading port through said back panel and located above said at least one lateral receiving member extending laterally across said back panel for loading bulk product there through; and b. a discharge port through said back panel and located toward said bottom of said back panel for discharging bulk product there through.

29. The flexible apparatus of claim 28 wherein said planar overlapping sections of said first sheet member, second sheet member and third sheet member with said back panel further comprises;

a. attachment points of each of said first pair of diagonal sections, second pair of diagonal sections, and third diagonal sections to said back panel in spaced apart relationship across said back panel and located between said loading port and said discharge port on said back panel.

30. The flexible apparatus of claim 29 wherein said first pair of diagonal sections, second pair of diagonal sections, and said third pair of diagonal sections further comprises;

a. descending edges on the top side of said first pair of diagonal sections, second pair of diagonal sections, and third pair of diagonal sections from said attachment points to said sidewalls to said back panel attachment points for creating said overlapping sections of said first, second, and third sheet members with said back panel between said loading port and said discharge port on said back panel, and b. ascending edges on the bottom side of said first pair of diagonal sections, second pair of diagonal sections, and third pair of diagonal sections from said attachment points to said sidewalls to said back panel attachment points for creating said overlapping sections of said first, second, and third sheet members with said back panel between said loading port and said discharge port on said back panel.

31. The flexible apparatus of claim 30 wherein said distance sufficient for creating said angles of from 20° to 55° between said sidewalls and said first, second and third sheet diagonal sheet members further comprising:

a. 33.5 cm to 78.5 cm from said back panel along each of said sidewalls for said first pair of diagonal sheet members, b. 117.50 cm to 162.5 cm from said back panel along each of said sidewalls for creating said second pair of diagonal sheet members, and c. 179 cm to 224 cm from said back panel along each of said sidewalls for creating said third pair of diagonal sheet members.

* * * * *